US009379479B2

(12) United States Patent
Ohnuma

(10) Patent No.: US 9,379,479 B2
(45) Date of Patent: Jun. 28, 2016

(54) CONNECTION TERMINAL

(71) Applicant: YAZAKI CORPORATION, Minato-ku, Tokyo (JP)

(72) Inventor: Kentaro Ohnuma, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/494,879

(22) Filed: Sep. 24, 2014

(65) Prior Publication Data

US 2015/0011116 A1 Jan. 8, 2015

Related U.S. Application Data

(63) Continuation of application No. PCT/JP2013/002030, filed on Mar. 26, 2013.

(30) Foreign Application Priority Data

Mar. 30, 2012 (JP) ..... 2012-081818

(51) Int. Cl.
*H01R 4/20* (2006.01)
*H01R 13/52* (2006.01)
*H01R 4/18* (2006.01)

(52) U.S. Cl.
CPC ..... *H01R 13/5216* (2013.01); *H01R 4/18* (2013.01); *H01R 4/185* (2013.01); *H01R 4/187* (2013.01); *H01R 4/20* (2013.01); *H01R 13/5219* (2013.01)

(58) Field of Classification Search
CPC ..... H01R 4/20; H01R 4/185; H01R 13/58; H01R 12/69; H01R 2201/26; H01R 4/01; H01R 4/24
USPC ..... 439/877, 865, 741, 430, 442, 203, 585; 174/84 C
See application file for complete search history.

(56) References Cited

U.S. PATENT DOCUMENTS 3,686,746 A 8/1972 Gwyn, Jr.
3,956,823 A * 5/1976 Kuo ..... 29/863

(Continued)

FOREIGN PATENT DOCUMENTS

JP 2011181499 A 9/2011
JP 2011210593 A 10/2011

(Continued)

OTHER PUBLICATIONS

Chinese Office Action issued on Jan. 6, 2016 in the counterpart Chinese patent application.

(Continued)

*Primary Examiner* — Abdullah Riyami
*Assistant Examiner* — Harshad Patel
(74) *Attorney, Agent, or Firm* — Mots Law, PLLC

(57) ABSTRACT

A connection terminal includes: a terminal connection portion to be connected with a mating terminal; a wire connection portion including a pair of crimping pieces crimped to an exposed conductor and insulation sheath of a wire; an anticorrosion material provided to cover the exposed conductor and insulation sheath exposed on an outside of the wire connection portion and cover a gap provided in a portion where edges of the respective crimping pieces face and come into contact with each other; and an anticorrosion material holding portion provided in the portion where the edges of the respective crimping pieces face and come into contact with each other.

15 Claims, 5 Drawing Sheets

(56) References Cited

U.S. PATENT DOCUMENTS

| | | | | |
|---|---|---|---|---|
| 3,990,143 | A * | 11/1976 | Dittmann et al. | 29/865 |
| 5,532,433 | A * | 7/1996 | Endo et al. | 174/84 C |
| 7,828,611 | B2 * | 11/2010 | Nakamura et al. | 439/877 |
| 7,905,755 | B1 * | 3/2011 | Martauz | 439/877 |
| 8,622,776 | B2 * | 1/2014 | Morikawa et al. | 439/886 |
| 8,870,611 | B2 * | 10/2014 | Sato et al. | 439/877 |
| 2010/0120302 | A1 * | 5/2010 | Kumakura | 439/878 |
| 2011/0070770 | A1 | 3/2011 | Sakai | |
| 2011/0083324 | A1 | 4/2011 | Martauz et al. | |
| 2013/0012077 | A1 | 1/2013 | Sato et al. | |
| 2015/0011117 | A1 * | 1/2015 | Ohnuma | 439/520 |

FOREIGN PATENT DOCUMENTS

| | | | |
|---|---|---|---|
| JP | 2012064575 | A | 3/2012 |
| WO | 2009156653 | A1 | 12/2009 |
| WO | 2011/122302 | A1 | 1/2011 |
| WO | 2011125626 | A1 | 10/2011 |

OTHER PUBLICATIONS

Japanese Office Action issued on Mar. 29, 2016 in the counterpart Japanese patent application (and English translation).

Japanese office action issued on Oct. 13, 2015 in the counterpart Japanese patent application.

* cited by examiner

CONNECTION TERMINAL

CROSS REFERENCE TO RELATED APPLICATION

This application is a Continuation of PCT Application No. PCT/JP2013/002030, filed on Mar. 26, 2013, and claims the priority of Japanese Patent Application No. 2012-081818, filed on Mar. 30, 2012, the content of both of which is incorporated herein by reference.

BACKGROUND

1. Technical Field

The present invention relates to a connection terminal including a terminal connection portion and a wire connection portion, in which a part of a wire exposed on the outside of the wire connection portion is covered with an anticorrosion material.

2. Related Art

WO 2011/125626 A1 discloses a conventional connection terminal. As illustrated in FIGS. 1 to 3, a conventional connection terminal 50 includes a terminal connection portion 51 to be connected with a mating terminal, a wire connection portion 52 connected to a wire W, and a neck portion 53 connecting the terminal connection portion 51 to the wire connection portion 52. The wire connection portion 52 includes a pair of crimping pieces 52*a*. The exposed part of a conductor 60 of the wire W and a part of an insulation sheath 61 are integrally crimped by the crimping pieces 52*a*. In the wire connection portion 52, an area where water may be poured to the wire W is covered with solder 55 as an anticorrosion material. In particular, the solder 55 is provided to cover an exposed part of the conductor 60 on an outside of the crimping pieces 52*a*, and cover a gap provided in a portion where the crimping pieces 52*a* face and come into contact with each other.

In the conventional connection terminal 50, it is possible to prevent pouring water to the conductor 60 even when the connection terminal 50 pours water. In particular, in a case where the conductor 60 is made of aluminum, galvanic corrosion can be prevented.

As illustrated in FIG. 4A, the conductor 60 is crimped by the crimping pieces 52*a* in a manner such that the respective edges of the crimping pieces 52*a* sink into the conductor 60. On the other hand, as illustrated in FIG. 4B, the insulation sheath 61 is crimped by the crimping pieces 52*a* in a manner such that the respective edges of the crimping pieces 52*a* merely face and come into contact with each other. This is because, for example, the edges of the crimping pieces 52*a* cannot sink into the insulation sheath 61 by crimping.

Thus, although a recess 56 is provided in the edge portions of the crimping pieces 52*a* where the conductor 60 is crimped, the edge portions of the crimping pieces 52*a* where the insulation sheath 61 is crimped, are not provided with a recess. Solder 55 as an anticorrosion material is applied to the area where the respective crimping pieces 52*a* having such a configuration come into contact with each other. The solder 55 is provided in a manner such that the solder in a molten state is applied by use of a soldering iron, or soldering paste is applied and then heated. The solder 55 in the molten state is stored in the recess 56 in the edge portions of the crimping pieces 52*a* where the conductor 60 is crimped.

SUMMARY

The solder 55 in the molten state tends to flow out of the edge portions of the crimping pieces 52*a* where the insulation sheath 61 is crimped. As a result, the amount of the solder 55 covering the gap in the crimping pieces 52*a* decreases and a water cut-off performance of the solder 55 thus decreases. The decrease of the water cut-off performance may cause a resistance increase of the wire connection portion 52 and a decrease of a wire fixing capacity.

Therefore, the present invention has been made in view of the above-described conventional problem. It is an object of the present invention to provide a connection terminal capable of preventing a resistance increase of a wire connection portion and a decrease of a wire fixing capacity derived from a decrease of a water cut-off performance of an anticorrosion material.

A connection terminal according to a first aspect of the present invention includes: a terminal connection portion to be connected with a mating terminal; a wire connection portion including a pair of crimping pieces crimped to an exposed conductor and insulation sheath of a wire; an anticorrosion material provided to cover the exposed conductor and insulation sheath exposed on an outside of the wire connection portion, and cover a gap provided in a portion where edges of the respective crimping pieces face and come into contact with each other; and an anticorrosion material holding portion provided in the portion where the edges of the respective crimping pieces face and come into contact with each other and the insulation sheath is crimped to the crimping pieces.

The anticorrosion holding portion may be further provided in a portion corresponding to a portion where the exposed conductor is crimped to the crimping pieces.

The exposed conductor and the insulation sheath may be integrally crimped by the crimping pieces. The anticorrosion material may be solder.

In accordance with the connection terminal according to the first aspect of the present invention, when the anticorrosion material is provided in the portion where the edges of the respective crimping pieces face and come into contact with each other, the anticorrosion material in a molten state is stored in the anticorrosion material holding portion provided also in the portion where the insulation sheath is crimped, so that the anticorrosion material does not easily flow out. Therefore, it is possible to prevent a resistance increase of the wire connection portion and a decrease of a wire fixing capacity derived from a decrease of a water cut-off performance of the anticorrosion material.

DETAILED DESCRIPTION

Figure 1:
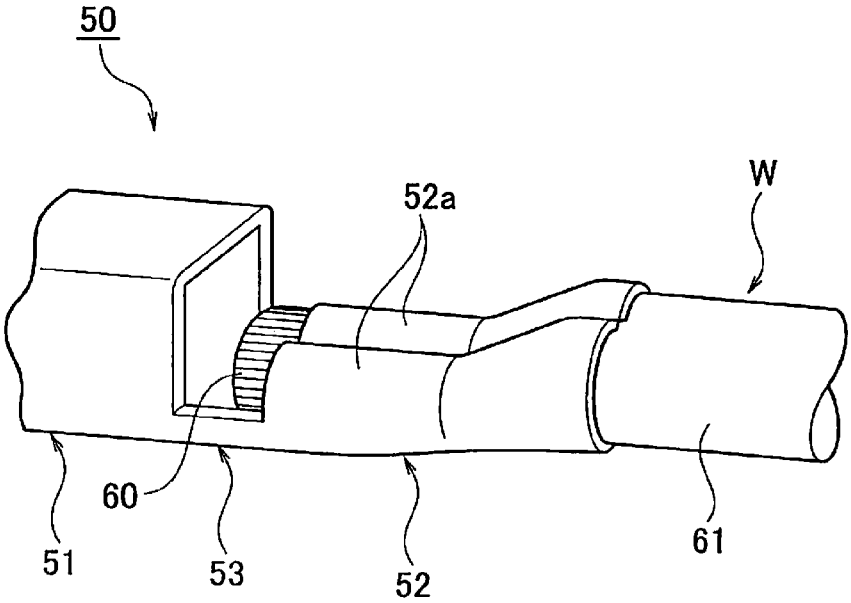
FIG. 1 PRIOR ART
FIG. 1 is a perspective view of a main part of a connection terminal according to a conventional example before solder is applied thereto.
Figure 2:
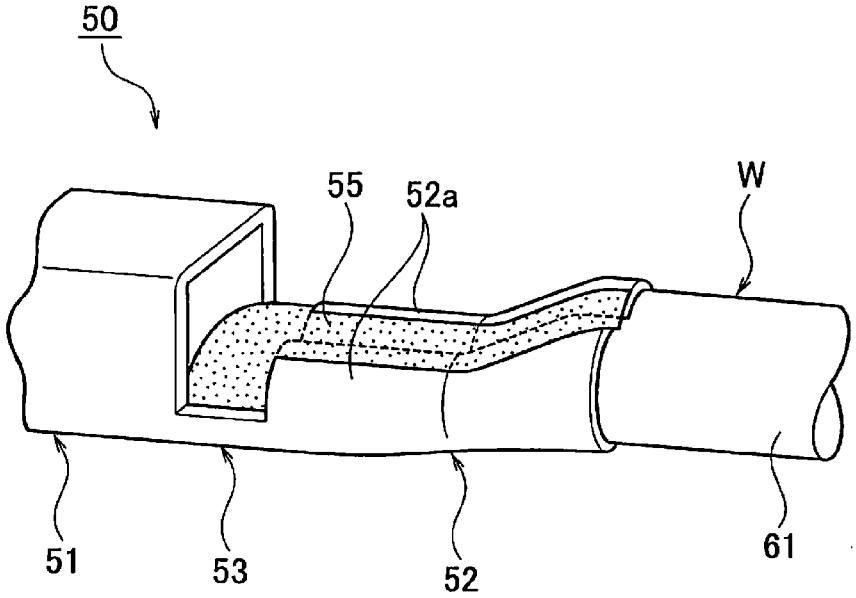
FIG. 2 PRIOR ART
FIG. 2 is a perspective view of the main part of the connection terminal according to the conventional example.
Figure 3:
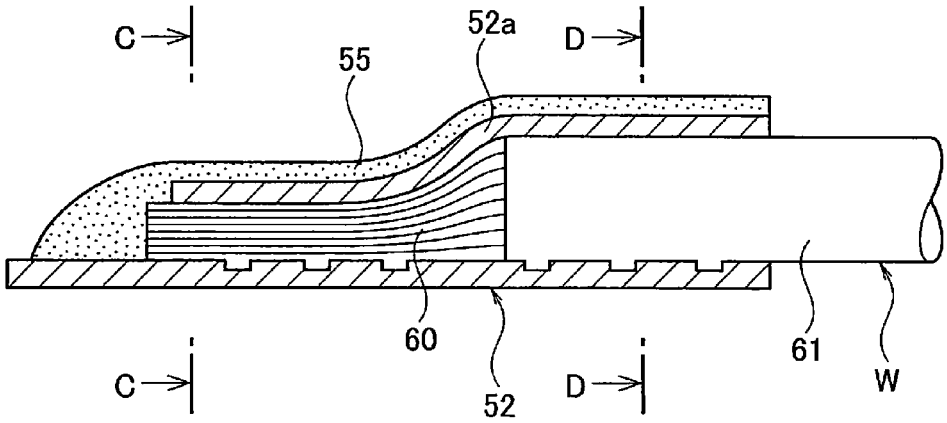
FIG. 3 PRIOR ART
FIG. 3 is a cross sectional view of the main part of the connection terminal according to the conventional example.
Figure 4A:
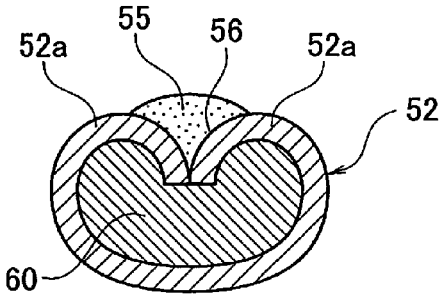
FIG. 4A PRIOR ART
FIG. 4A is a cross sectional view along the line C-C in FIG. 3.
Figure 4B:
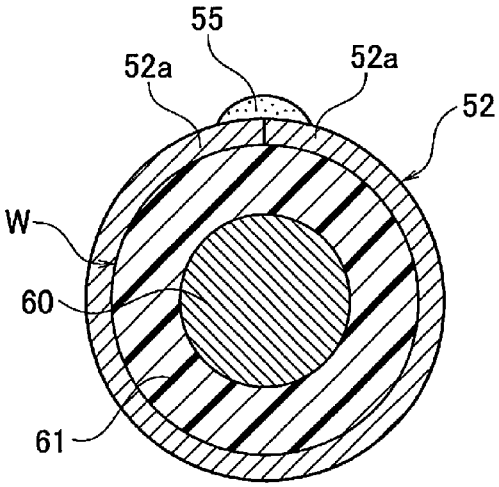
FIG. 4B PRIOR ART
FIG. 4B is a cross sectional view along the line D-D in FIG. 3.

Hereinafter, embodiments according to the present invention will be explained with reference to the drawings.

(Embodiment)

FIGS. 5 to 9 illustrate an embodiment of the present invention.

A connection terminal 1 according to the embodiment includes a terminal connection portion 2 to be connected with a mating terminal (not illustrated), a wire connection portion 10 connected to a wire W, and a neck portion 20 connecting the terminal connection portion 2 to the wire connection portion 10. The terminal connection portion 2, the wire connection portion 10, and the neck portion 20 are formed in a manner such that a conductive metal plate made of a copper alloy having a predetermined shape is bent.

The terminal connection portion 2 includes a square cylindrical portion 3, and an elastic contact piece (not illustrated) disposed inside the cylindrical portion 3. When the mating terminal is inserted into the cylindrical portion 3, the mating terminal comes into close contact with the cylindrical portion 3 by an elastic restoring force of the elastic contact piece. As a result, the mating terminal is electrically connected to the terminal connection portion 2.

The wire connection portion 10 includes a wire connection portion bottom wall 11, a pair of wire connection portion side walls 12 extending from both side edges of the wire connection portion bottom wall 11, and a pair of crimping pieces 13 further extending from the respective wire connection portion side walls 12.

Each of the crimping pieces 13 includes a conductor crimping portion 13*a* located towards a front side, and a sheath crimping portion 13*b* connected to the conductor crimping portion 13*a* and located towards a rear side. The sheath crimping portion 13*b* connected to the conductor crimping portion 13*a* includes a portion formed in a tapered shape. In each of the crimping pieces 13, an extending height of the sheath crimping portion 13*b* is higher than that of the conductor crimping portion 13*a*. The crimping pieces 13 hold a conductor 30 of the wire W, which is made of aluminum or aluminum alloy, by crimping the conductor crimping portions 13*a*, and hold an insulation sheath 31 of the wire W by crimping the sheath crimping portions 13*b*. Namely, the conductor 30 and the insulation sheath 31 are integrally crimped by the crimping pieces 13.

Figure 9A:
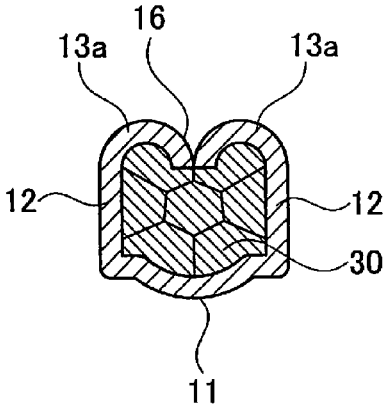
FIG. 9A is a cross sectional view along the line B1-B1 in FIG. 7.
Figure 9B:
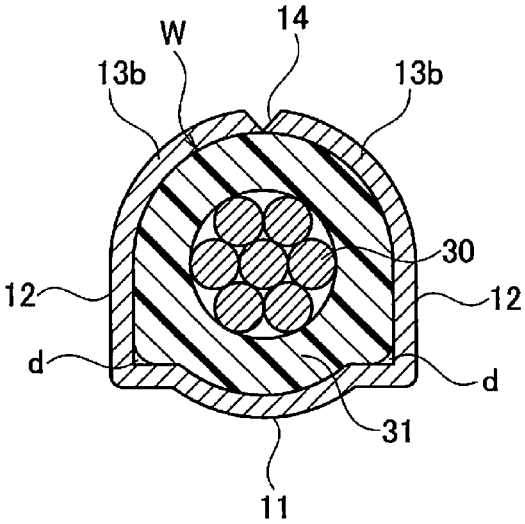
FIG. 9B is a cross sectional view along the line B2-B2 in FIG. 7.

The pair of the crimping pieces 13 is crimped in a manner such that each edge of the crimping pieces 13 faces and comes into contact with each other. In particular, as illustrated in FIG. 9A, the conductor crimping portions 13*a* are crimped in a manner such that each edge sinks into the conductor 30. Therefore, a recess 16 is provided in the edge portions of the conductor crimping portions 13*a*. As illustrated in FIG. 9B, the sheath crimping portions 13*b* are crimped in a manner such that the respective edges merely face and come into contact with each other. The sheath crimping portions 13*b* are provided with an anticorrosion material holding portion 14 formed into a V-like shaped groove in the portion where the respective edges face and come into contact with each other.

The anticorrosion material holding portion 14 is formed in a manner such that each edge of the sheath crimping portions 13*b* is cut into a tapered shape. The anticorrosion material holding portion 14 holds solder 25 in a molten state inside the V-like shaped groove so as to prevent the solder 25 from flowing out. The anticorrosion material holding portion 14 is provided at least in the area corresponding to the portion where the insulation sheath 31 is crimped to the sheath crimping portions 13*b*.

The fixing position of the wire W to the wire connection portion 10 is shifted to some extent. In this case, a boundary between the conductor 30 and the insulation sheath 31 is also shifted within an area where the crimping pieces 13*b* are provided. A front end position of the anticorrosion material holding portion 14 is determined in a manner such that the anticorrosion material holding portion 14 includes at least the area where the boundary between the conductor 30 and the insulation sheath 31 is shifted. A rear end position of the anticorrosion material holding portion 14 may be the rear end of the sheath crimping portions 13*b*. The anticorrosion material holding portion 14 is thus provided at least in the area corresponding to the portion where the insulation sheath 31 is crimped to the sheath crimping portions 13*b*.

The neck portion 20 includes a neck portion bottom wall 21, and a pair of neck portion side walls 22 elongated upward from both edges of the neck portion bottom wall 21. The neck portion bottom wall 21 and the neck portion side walls 22 are integrated with the terminal connection portion 2 and with each wall of the wire connection portion 10.

An area in the wire connection portion 10 where water may be poured the wire W, is covered with the solder 25 as an anticorrosion material. In particular, the solder 25 is provided to cover the exposed part of the conductor 30 on an outside of the crimping pieces 13, and cover a gap between the pair of the crimping pieces 13. The solder 25 may be provided in a manner such that the solder in a molten state is applied by use of a soldering iron, or soldering paste is applied and then heated.

Figure 5A:
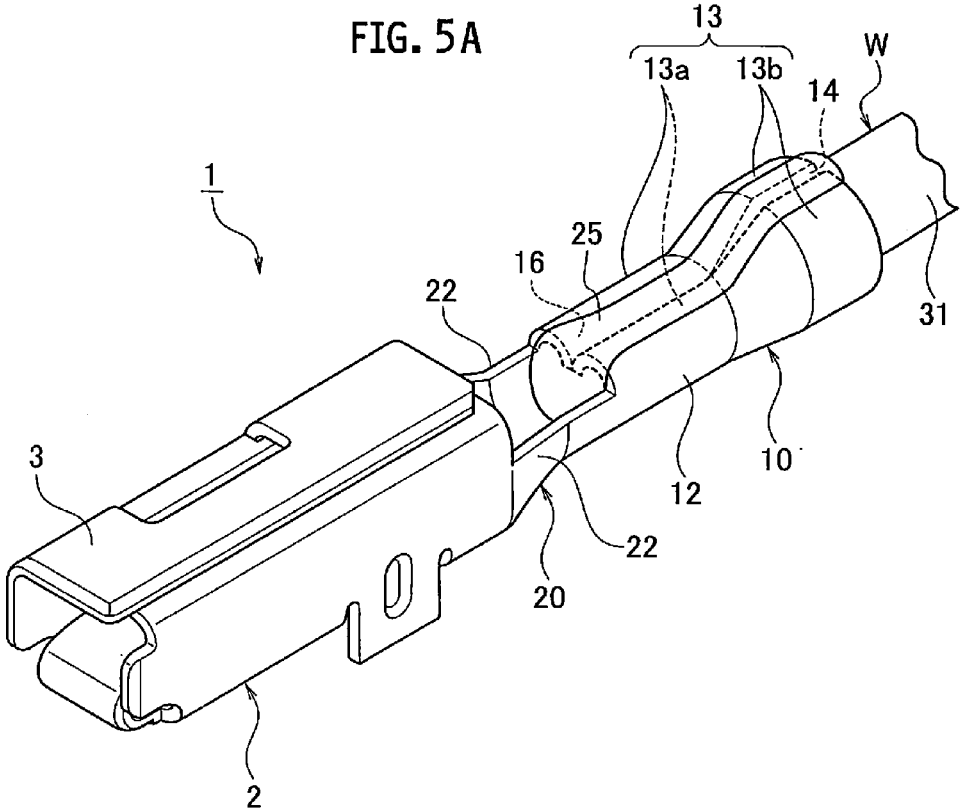
FIG. 5A is a perspective view of a connection terminal according to an embodiment.
Figure 5B:
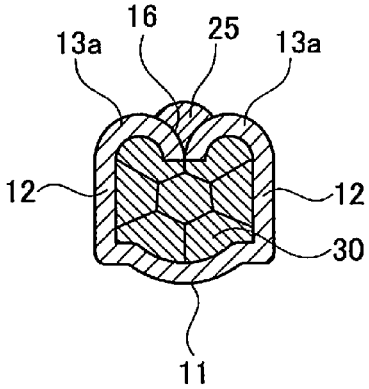
FIG. 5B is a cross sectional view of a portion where a conductor is crimped to the contact terminal according to the embodiment.
Figure 5C:
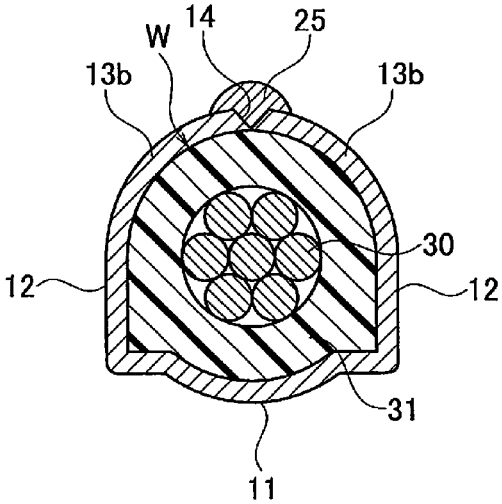
FIG. 5C is a cross sectional view of a portion where an insulation sheath is crimped to the contact terminal according to the embodiment.
Figure 6:
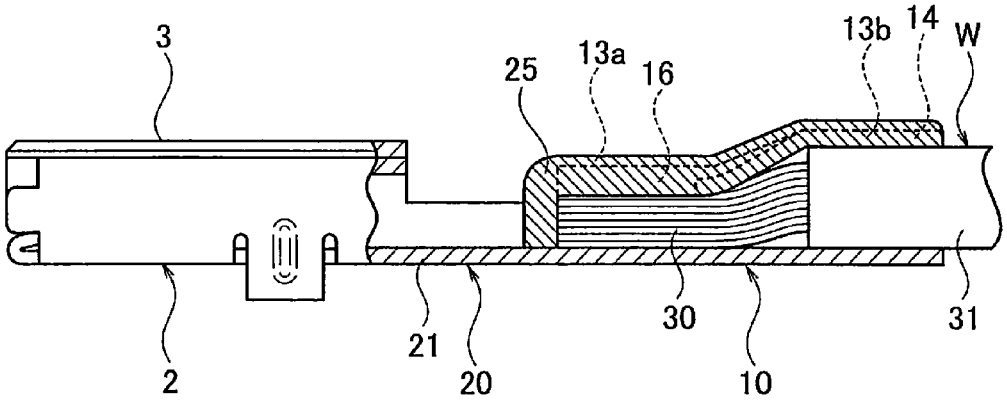
FIG. 6 is a partially exploded cross sectional view of the connection terminal according to the embodiment.
Figure 7:
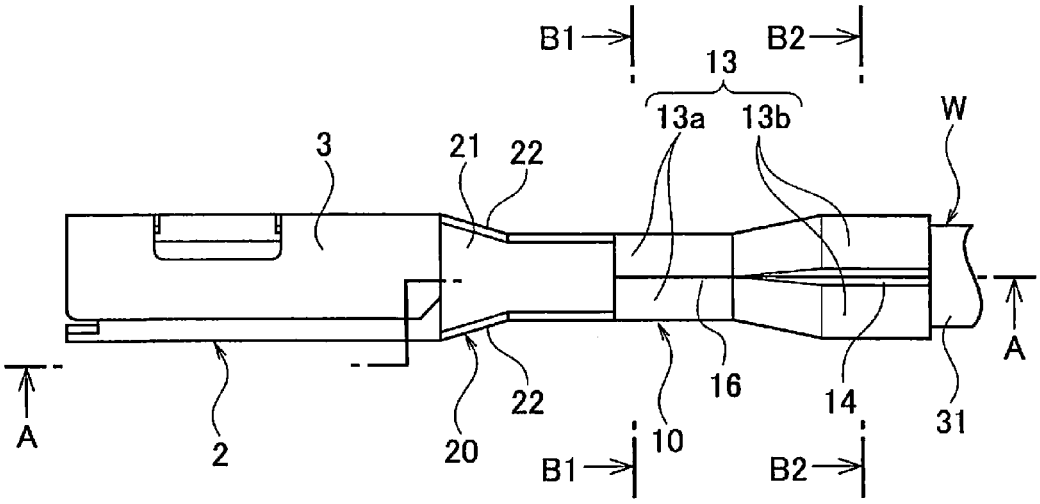
FIG. 7 is a plan view of the connection terminal according to the embodiment before solder is applied thereto.
Figure 8:
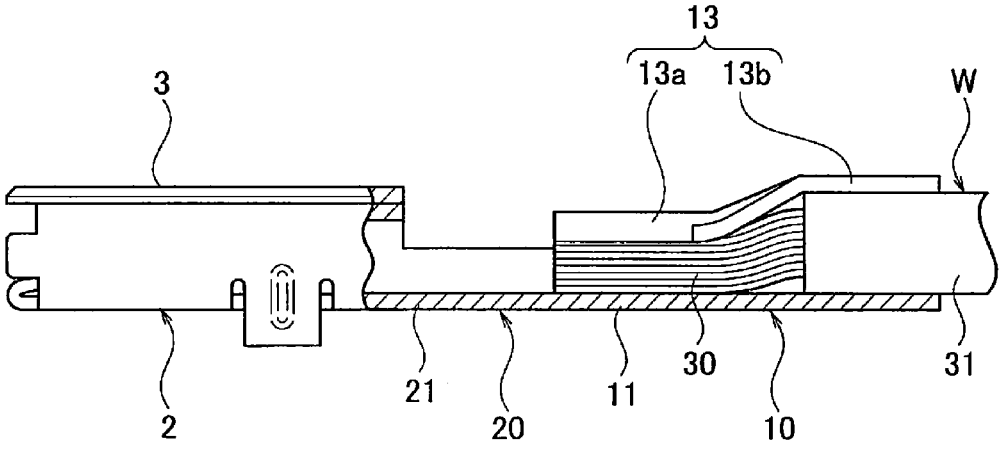
FIG. 8 is a cross sectional view along the line A-A in FIG. 7.

The solder 25 in the molten state applied on the gap between the pair of the crimping pieces 13 enters the recess 16 in the conductor crimping portions 13*a* (where the conductor 30 is crimped) provided by bending the pair of the crimping pieces 13, and the solder 25 is thus stored therein, as illustrated in FIG. 5B. The solder 25 also enters the corrosion material holding portion 14 in the sheath crimping portions 13*b* (where the insulation sheath 31 is crimped, and where a part of the conductor 30 is located), and the solder 25 is thus stored therein, as illustrated in FIG. 5C. Therefore, the solder 25 does not easily flow out from the recess 16 and the corrosion material holding portion 14. Since the gap between the pair of the crimping pieces 13 is covered with a preferred amount of the solder 25, a water cut-off performance is increased. As a result, it is possible to prevent a resistance increase of the wire connection portion 10 and a decrease of a wire fixing capacity derived from a decrease of the water cut-off performance. In particular, in the case in which the conductor 30 is made of aluminum or an aluminum alloy, galvanic corrosion of the conductor 30 can surely be prevented.

Once heat caused by the solder 25 in the molten state is transmitted to the insulation sheath 31, an outer surface of the insulation sheath 31 is deformed to fill gaps "d" (see FIG. 9B) present between the outer surface of the insulation sheath 31 and the inner surface of the wire connection portion 10. Such deformation can also improve the water cut-off performance and thereby prevent the resistance increase of the wire connection portion 10 and the decrease of the wire fixing capacity.

The anticorrosion material holding portion 14 is provided at least in the area corresponding to the portion where the insulation sheath 31 is crimped to the sheath crimping portions 13*b*. Therefore, the portion where the insulation sheath 31 is crimped can surely be covered with a preferred amount of the solder 25.

(Modified Examples)

In the connection terminal 1 according to the embodiment, the anticorrosion material holding portion 14 is provided at least in the area corresponding to the portion where the insulation sheath 31 is crimped to the sheath crimping portions 13*b*. However, in the case of crimping by the conductor crimping portions 13*a* which are not provided with the recess 16, the anticorrosion material holding portion 14 may be provided in the entire area where the respective edges of the pair of the crimping pieces 13 face and come into contact with each other.

The anticorrosion material holding portion 14 of the connection terminal 1 according to the embodiment has a V-like shaped groove, which can be obtained in a manner such that each edge of the crimping pieces 13 is cut into a tapered shape. Therefore, the anticorrosion material holding portion 14 can be easily manufactured. However, the anticorrosion material holding portion 14 is not limited to the V-like shaped groove as long as the anticorrosion material holding portion 14 can hold and store the anticorrosion material in the molten state such as solder.

Although the solder 25 is used as the anticorrosion material in the connection terminal 1 according to the embodiment, grease, hot-melt adhesive, or the like may be used as the anticorrosion material.

Although the conductor 30 in the connection terminal 1 according to the embodiment is made of aluminum or aluminum alloy, the conductor 30 may be made of copper or the like.

What is claimed is:

1. A connection terminal, comprising:

a wire comprising a conductor and an insulation sheath covering the conductor, one end side of the conductor exposed from the insulation sheath;

a terminal connection portion to be connected with a mating terminal;

a wire connection portion comprising a pair of crimping pieces each comprising a conductor crimping portion and a sheath crimping portion integrally connected to the conductor crimping portion, the conductor crimping portion crimped to the exposed conductor, the sheath crimping portions arranged on a surface of the insulation sheath where distal edges of the respective sheath crimping portions face and come into contact with each other;

an anticorrosion material provided to cover the exposed conductor and insulation sheath exposed on an outside of the wire connection portion, and cover a gap provided in a portion where the distal edges of the respective sheath crimping portions face and come into contact with each other, and an anticorrosion material holding portion provided in the portion where the distal edges of the respective sheath crimping portion face and come into contact with each other, wherein the sheath crimping portion includes a taper portion formed in a tapered shape connected to the conductor crimping portion, wherein a width of the anticorrosion material holding portion gradually narrows in the taper portion along a terminal longitudinal direction from a rear side to a front side, wherein the anticorrosion material holding portion holds and stores the anticorrosion material in the molten state to prevent the anticorrosion material from flowing out.

2. The connection terminal according to claim 1, wherein the anticorrosion holding portion is further provided in a portion where edges of the respective conductor crimping portions face and come into contact with each other.

3. The connection terminal according to claim 1, wherein the anticorrosion material is solder.

4. The connection terminal according to claim 1, wherein the anticorrosion material holding portion is formed into a V-shaped groove in the portion where the distal edges of the respective sheath crimping portions face and come into contact with each other.

5. The connection terminal according to claim 4, wherein the anticorrosion material is solder, wherein the V-shaped groove holds the solder in a molten state so as to prevent the solder from flowing out into the terminal connection portion.

6. The connection terminal according to claim 1, wherein the anticorrosion material holding portion is formed such that each edge of the sheath crimping portions is cut into a tapered shape.

7. The connection terminal according to claim 1, wherein the anticorrosion material holding portion is provided in at least in the portion where the distal edges of the respective sheath crimping portions face and come into contact with each other.

8. The connection terminal according to claim 1, wherein a front end position of the anticorrosion material holding portion with reference to a fixing position of the wire is determined such that the anticorrosion material holding portion includes at least an area of the boundary between the conductor and the insulation sheath.

9. The connection terminal according to claim 1, wherein a rear end position of the anticorrosion material holding portion comprises a rear end of the sheath crimping portions.

10. The connection terminal according to claim 1, further comprising a neck portion including a neck portion bottom wall and a pair of neck portion side walls elongated upward from both edges of the neck portion bottom wall.

11. The connection terminal according to claim 10, wherein the neck portion bottom wall and the neck portion side walls are integrated with the terminal connection portion and with each wall of the wire connection portion.

12. The connection terminal according to claim 1, wherein the anticorrosion material is solder, wherein the anticorrosion material holding portion is configured to store the solder such that the solder does not easily flow out from the anticorrosion holding portion.

13. The connection terminal according to claim 1, wherein the anticorrosion material holding portion is provided in the entire area where the respective edges of the pair of crimping pieces face and come into contact with each other.

14. The connection terminal according to claim 13, wherein the anticorrosion material holding portion is formed into a V-like shaped groove in the entire area where the respective edges of the pair of crimping pieces face and come into contact with each other.

15. The connection terminal according to claim 1, wherein the sheath crimping portion comprises a wire connection portion bottom wall extending along the longitudinal direction of the terminal and having, in a cross section perpendicular to a longitudinal direction of the terminal, a curved portion recessed in an arc shape and arranged in a center part in the width direction of the terminal and a flat portion formed on each of the side edges of the curved portion, and a pair of wire connection portion side walls protruding from each of the side edges of the wire connection portion bottom wall, wherein gaps between the insulation sheath and corner parts formed with the wire connection portion bottom wall and the wire connection portion side walls are configured to be filled with the insulation sheath deformed with heat transmitted from the anticorrosion material in the molten state.

* * * * *